United States Patent [19]

Yokoyama

[11] Patent Number: 5,037,366

[45] Date of Patent: Aug. 6, 1991

[54] DEVICE FOR ATTACHING A STRAW TO A CARTON CONTAINER

[75] Inventor: Yoshimitsu Yokoyama, Ishikawa, Japan

[73] Assignee: Gilliland Industrials Corporation, Spartanburg, S.C.

[21] Appl. No.: 524,623

[22] Filed: May 17, 1990

[51] Int. Cl.[5] ..... B65B 19/34

[52] U.S. Cl. ..... 493/84; 53/128.1; 53/410

[58] Field of Search ..... 493/84, 45, 48; 53/410, 53/128, 272, 276, 292, 293, 302, 308, 367

[56] References Cited

U.S. PATENT DOCUMENTS

| | | | |
|---|---|---|---|
| 4,293,369 | 10/1981 | Dilot et al. | 53/520 |
| 4,372,797 | 2/1983 | Dilot et al. | 53/410 |
| 4,384,915 | 5/1983 | Utsumi | 493/383 |
| 4,572,758 | 2/1986 | Wild | 53/410 |
| 4,584,819 | 9/1986 | Hakansson | 53/410 |
| 4,641,481 | 2/1987 | Brosten | 53/128 |
| 4,669,699 | 6/1987 | Kaneko | 53/128 |
| 4,707,965 | 11/1987 | Becker | 53/410 |
| 4,903,458 | 2/1990 | Hakansson | 53/128 |

*Primary Examiner*—Frederick R. Schmidt
*Assistant Examiner*—John A. Marlott
*Attorney, Agent, or Firm*—Earle R. Marden; H. William Petry

[57] ABSTRACT

A straw applicator to seal an encapsulated straw to the side of a carton container which employs a rotating drum having concave sections to pick up the straw and carry it to the severing and sealing position.

1 Claim, 1 Drawing Sheet

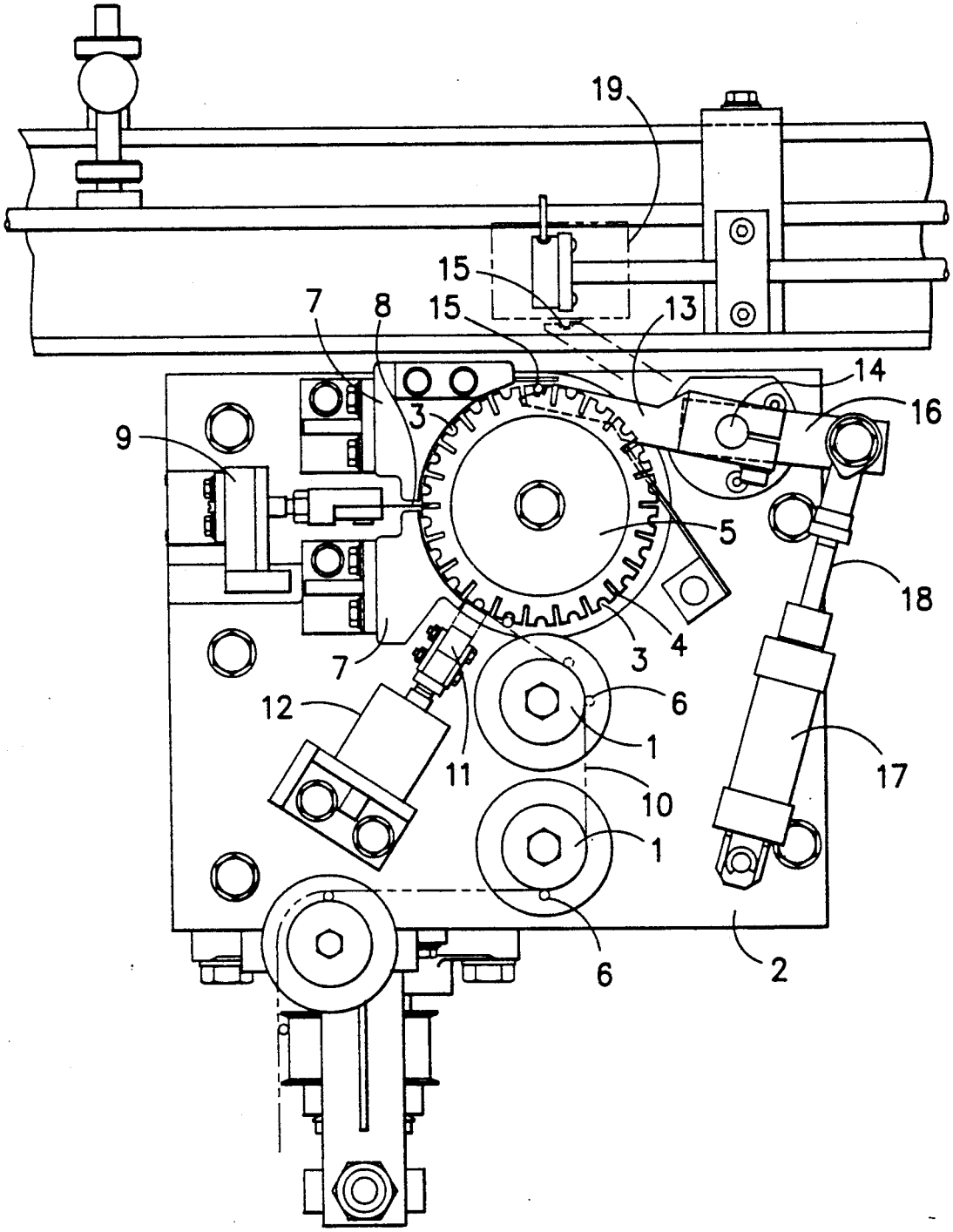
19
15
7
8
15
13
14
16
9
3
5
18
4
3
7
6
12
1
11
17
10
1
6
2

DEVICE FOR ATTACHING A STRAW TO A CARTON CONTAINER

DETAILED EXPLANATION OF THE INVENTION

1. Field of Industrial Use

This invention relates to a device which attaches a straw, which is used when drinking, to the side face of a carton container that has been filled with a liquid such as milk or juice.

2. Prior Art

Previously, a mechanism which positively inserts a straw into a concave section of a rotating drum has not existed.

Problems to be solved by the invention:

The straws which are glued to the side of a carton container are sealed in bags and wound around a drum in a continuous belt-like form and are supplied from there, but because the drum is removed and installed in a perpendicular condition due to problems such as equipment space, the straws are in a horizontal position.

Therefore, the straw which is fed out from the drum is guided into a guide roller in a condition in which it is twisted 90 degrees, and inserted into a concave section of a rotating drum which is intermittently rotating, but it does not become completely upright without a bending and kinking of the straw.

Therefore, when the straw reaches the concave section of the rotating drum in a slanted position, a portion of the straw is inserted into the concave section, but since the other portion is not inserted and is at variance with the guide wall in that position, the portion of the straw which is loosely inserted into the concave section strikes against the end of the guide wall is crushed, and becomes unusable.

Considering the above-mentioned points, this purpose of this invention is to offer a straw attachment device which can easily insert a straw that has been guided by a guide roller into the concave section of a rotating drum.

In order to achieve the above-mentioned goals, this invention is characterized by the fact that in a device for attaching a straw to a carton container, a rotating drum (5) is provided with concave sections (3) on its circumference into which straw (6), which is guided by means of guide roller (1), is installed in front of guide roller (1), and cutter (8) used for separating the straws is provided along with guide wall (7) being provided on the side and close to said rotating drum (5), and an arm (13) which removes the straw (6) which has been inserted in the above-mentioned rotating drum (5) and attaches it to cylinder (9) is provided on the side of rotating drum (5); a pushing tool (11) which inserts straw (6) into the concave section (3) of rotating drum (5) from the side is provided between guide roller (1) and guide wall (7).

BRIEF EXPLANATION OF THE FIGURE

The FIGURE is a plane view that shows an application example of device of this invention.

1-Guide Roller; 3-Concave Section; 5-Rotating Drum; 6-Straw; 7-Guide Wall; 8-Cutter; 11-Pushing Tool; 13-Arm and 19-Carton Container.

OPERATION

The operation of the device of this invention is explained next. The straws which are sealed in bags, made into a continuous belt form and guided by means of a guide roller are successively inserted into the concave sections of a rotating drum, which intermittently rotates at the front of a guide roller, and are transferred along the guide wall, but due to the fact that the straw is not in a completely upright position and a twisting and kinking is imparted, and is fed on in a slightly slanted position, one portion of the straw is inserted into the concave section, but the other portion is free without being inserted.

At that point, if the pushing tool that is provided between the guide roller and the guide wall is extended out, the tip pushes the entire surface of the straw, and the straw is inserted in the concave section. Then the straw which has been temporarily inserted in the concave section, due to the fact that the diameter of the straw is slightly larger than the diameter of the concave section, does not come out.

Moreover, the straw which has been inserted into the concave section is moved along the guide wall without impacting the end section of the guide wall, is successively cut off one at a time by means of a cutter that is part-way along on the guide wall, and after traveling past the guide wall, is extracted from the concave section by means of an arm, and is attached to the side of the carton container.

EXAMPLE

An application example of this invention is explained below, based on the figure. The figure is a plane view of a device of this invention. In the figure, (1) is the guide rollers that are provided on base (2), and provided in front of said guide roller (1) is rotating drum (5), in which, along with concave section (3) used for the straw insertion being formed at fixed intervals in the vertical directions on its circumference, grooves (4) are formed in the vertical direction between each of the grooves (3).

Concave section (3) is formed slightly smaller than the diameter of straw (6), and is made so that they will not naturally come out if they are temporarily inserted.

A guide wall (7) is provided on the side adjacent to rotating drum (5), and cutter (8) is provided part-way along said guide wall (7) closer to the side and is made so that it can be moved in and out by means of cylinder (9). When the end of said cutter (8) protrudes, it is pushed into groove (4) of the above-mentioned rotating drum (5), and straws (6), which come out in belt (10) sealed in a bag, are successively cut off one at a time.

A pushing tool (11) is provided between guide wall (7) and the guide roller (1) that is the closest to rotating drum (5), is pushed in by means of cylinder (12), and straw (6) is pushed by the tip of the pushing tool and inserted into concave section (3).

The tip of pushing tool (11) has about the same height as the height of the straw in the vertical direction, and uses [sic: is made of] silicon rubber or such.

An arm (13) whose base end is affixed to rotating shaft (14), and on the tip of which is provided straw engaging concave section (15), is attached to rotating shaft (14) above and below in two places.

A connecting leaf (16) links rotating shaft (14) and rod (18) of cylinder (17). Then, rotating shaft (14) rotates due to the fact that cylinder rod (18) pushes in, arm (13) is caused to move back and forth, straw (6) is removed from concave section (3) of rotating drum (5), and is inserted into the engaging concave section (15) of arm (13), and the straw is attached to a place where glue has been applied on the carton container (19) that has moved in front of rotating drum (5).

Also, rotating drum (5) has grooves (not shown in the figure) that are separated vertically so that arm (13) can move forward and backward.

EFFECTS OF THE INVENTION

According to this invention, when straws which are supplied by a belt sealed in bags are guided by means of guide rollers and inserted into the concave sections of a rotating drum, because they are pushed from the side by means of a pushing tool and inserted into a concave section, they are inserted uniformly along the top and bottom of the straw, even if, for example, a twisting and kinking is applied and it is slanted.

Therefore, there is no concern as there was previously for it to reach the guide wall in a loose condition, impact the end section of the guide wall and be crushed, and it is a profitable idea for preventing the straw from being rendered useless.

I claim:

1. A device for attaching a straw to a carton container comprising: a rotating drive having a plurality of grooves in the circumference thereof, a plurality of slots in the circumference of said drum having a depth greater than the depth of said grooves, one of said slots being located between adjacent grooves, guide roller means supplying a continuous web of straws to said drum, a guide plate closely adjacent the circumference of said drum holding said web of straws onto said drum, a first means to push a straw into one of said grooves as said web of straws is being conveyed to a cutter, a cutter means adjacent said drum to push a cutter through the web of material into said slot to separate a straw from said web of straws, means to index said drum to intermittently rotate same and a pivotally mounted arm member with a groove in the face thereof to remove a severed straw from the grooves of said drum and transfer the severed straw to a carton to which the straw is to be adhered, wherein said first means and said cutter means are activated by a cylinder means in sequence with the means to index said drum.

* * * * *